United States Patent [19]

Carson et al.

[11] Patent Number: 4,880,950

[45] Date of Patent: Nov. 14, 1989

[54] CONTROL SWITCH

[75] Inventors: Steven R. Carson, Upper Saddle River, N.J.; Raymond T. Griffin; Scott A. Spear, both of San Antonio, Tex.

[73] Assignee: Lightolier, Inc., Secaucus, N.J.

[21] Appl. No.: 160,358

[22] Filed: Feb. 23, 1988

[51] Int. Cl.[4] ..... H01H 15/00; H01C 10/44

[52] U.S. Cl. ..... 200/547; 200/330; 338/183

[58] Field of Search ..... 338/176, 179, 178, 183, 338/119; 200/329, 330, 338, 547, 549

[56] References Cited

U.S. PATENT DOCUMENTS

| | | | |
|---|---|---|---|
| 3,588,779 | 6/1971 | Goerg | 338/183 |
| 3,996,550 | 12/1976 | Yano et al. | 338/183 |
| 4,101,864 | 7/1978 | Van Benthaysen | 338/183 |
| 4,533,805 | 8/1985 | Fujinami et al. | 338/176 X |

*Primary Examiner*—Renee S. Luebke

[57] ABSTRACT

A control switch having an air gap safety lever, a novel slide arrangement, and an illuminated on-off control switch. The air gap safety lever is mounted on the control switch in such a manner that no power may flow through the circuits until the unit has been installed and the front cover plate mounted. The slide arrangement employs a thin clip which provides an aesthetically appealing slide control, the clip having special dimples which allow nearly frictionless movement. The illuminated on-off control switch utilizes a light piping which conveys light from an LED to the on-off button, the light piping doubling as a mechanical link between the on-off button and a momentary contact switch mounted inside the control switch. Also, a novel frame is disclosed which secures all mechanical and electrical components of the switch together without the necessity of attaching the back box, which simplifies test and repair before shipment of the unit from the factory.

9 Claims, 3 Drawing Sheets

CONTROL SWITCH

BACKGROUND OF THE INVENTION

1. Field of the Invention

The present invention generally relates to control switches, and more particularly to a device intended for use as a light dimmer switch.

2. Description of the Prior Art

Power switches are manufactured in all shapes and sizes for a sundry of different purposes. The present application is directed to a particular power switch which, although intended for use as a light dimmer, could be used with motors and in other applications. Electrical switches of the type referred to herein generally consist of two or more wires for connection to an external power source, a pair of metal contacts connected to these wires, and a lever or button used to actuate the contacts between open and closed states.

There are several different types of light switches. These include knife switches, mercury switches, turnstile type switches, tumbler switches, push-button switches and electromagnetic switches, all familiar to those skilled in the art. A network of lights may be managed by a single rotary power switch having a plurality of contacts. For light dimming circuits, early switches incorporated a rheostat or potentiometer for regulating the power transmitted to the light bulb. Modern dimmers use a triac firing circuit which generates considerably less heat and power loss than the older potentiometer configuration, although a variable resistor is still employed to adjust the firing range of the triac.

Several problems arise in the manufacture, installation, and use of dimmer switches. One such problem occurs in slide-type dimmers. The slide knob extends outward from the internal mechanism of the switch, leaving an unsightly gap which peers inside the device. Also, a relatively expensive bearing system must be provided to insure smooth movement of the slide along its path. These difficulties are encountered in the fabrication of the device, and no presently available switches provide a simplified slide arrangement.

Another problem relates to quality control testing of the switches. Typically, light switches are held together by a metallic strap on the front of the switch which is fastened to a surrounding box on the backside of the switch. The moving parts of the switch, as well as the circuitry, cannot be tested until the back box is in place, thereby securing all of the mechanical and electrical components together. If, however, a particular unit should fail the test performed just before packing, then the entire unit must be disassembled (i.e., the box and strap removed), in order to determine the cause of the failure. If this problem arises frequently in a mass production setting, it results in a substantial increase in labor costs during manufacture.

The next complication occurs during installation of the switch. With several types of switches, it is impossible to tell whether the switch is in an "on" or "off" state. This creates a safety hazard during installation since an electrician or homeowner may install a switch which is closed, exposing the person to a live circuit. Even if the switch is marked as to on and off positions, the installer may not notice what state the switch is in during installation. At the present time, there are no safety features associated with the switches themselves which would overcome this problem.

The final difficulty concerns finding the light switch when the room is completely dark. Several switches have been manufactured which overcome this problem by actually placing a small bulb within the device, for example, within a translucent lever arm which actuates the switch. The main disadvantage to this type of switch, however, is that the bulb eventually burns out.

It would, therefore, be desirable and advantageous to devise a light dimming switch which would overcome the above-stated problems. The present invention does so by providing (1) a novel slide arrangement having an ultrathin profile, (2) a switch frame which holds the components together without attachment of the back box, (3) a unique air gap lever which prevents premature actuation of the switch, and (4) a novel light pipe which doubles as an actuator arm for full on-off.

SUMMARY OF THE INVENTION

Accordingly, the primary object of the present invention is to provide a control switch for dimming lighting fixtures.

Another object of the invention is to provide such a switch with a sliding handle or knob having a slim profile and smooth operation.

Still another object of the invention is to provide a switch frame whereby all components of the switch may be held intact without final assembly of the switch, thereby simplifying correction of defects if the devise fails final testing.

Yet another object of the invention is to provide a safety feature preventing accidental shock during installation or change-out of a lamp.

A further object of the invention is to provide such a switch having an illuminated on-off button which is cost-effective and durable.

The foregoing objects are achieved in a control switch having a novel slide arrangement, frame, air gap lever, and light piping. The slide arrangement comprises a slide base interposed between a slide clip and slide knob, the slide clip having pairs of indented dimples which ride rails on the slide base. The frame surrounds the slide arrangement and has several clip arms which extended downward through the switch strap, and clip onto the printed circuit board containing the electrical components of the switch. The air gap lever is positioned on the front side of the switch and coupled to a butt contact in such a manner as to close the contact when the cover plate is attached to the switch in the final step of installation. Finally, the light piping is fixedly attached to the on-off button and extends to a momentary contact switch which abuts a light emitting diode.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of illustrative embodiments when read in conjunction with the accompanying drawings, wherein:

FIG. 3A is a side view of the slide arrangement; FIG. 3B is a rear elevational view thereof showing the slide clip riding on the rails of the slide base; FIG. 3C is a cross-section taken along lines 3C—3C of FIG. 3B; and FIG. 3D is an exploded perspective view of the components of the slide arrangement.

FIG. 4A is a side elevational view of the switch showing the air gap lever in its open state; FIG. 4B is similar to FIG. 4A but it shows the air gap lever in its closed state; FIG. 4C is a cross-section taken along lines 4C—4C of FIG. 4A.

DESCRIPTION OF THE PREFERRED EMBODIMENTS

Figure 1:
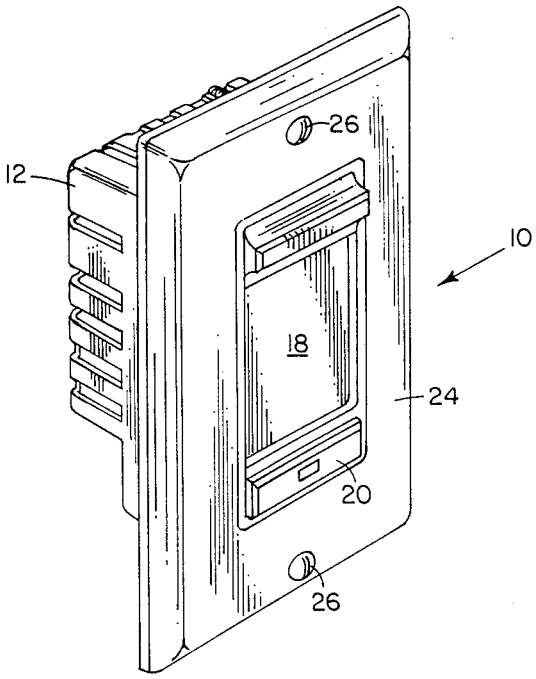
FIG. 1 is a perspective view of the assembled control switch.
Figure 3D:
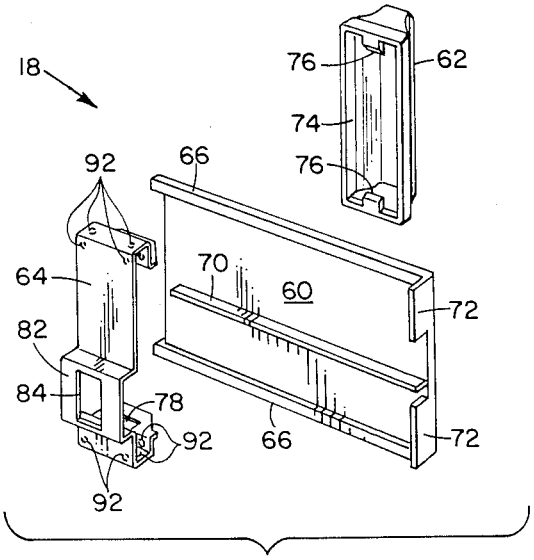
FIGS. 3A through 3D relate to the slide arrangement.
Figure 2:
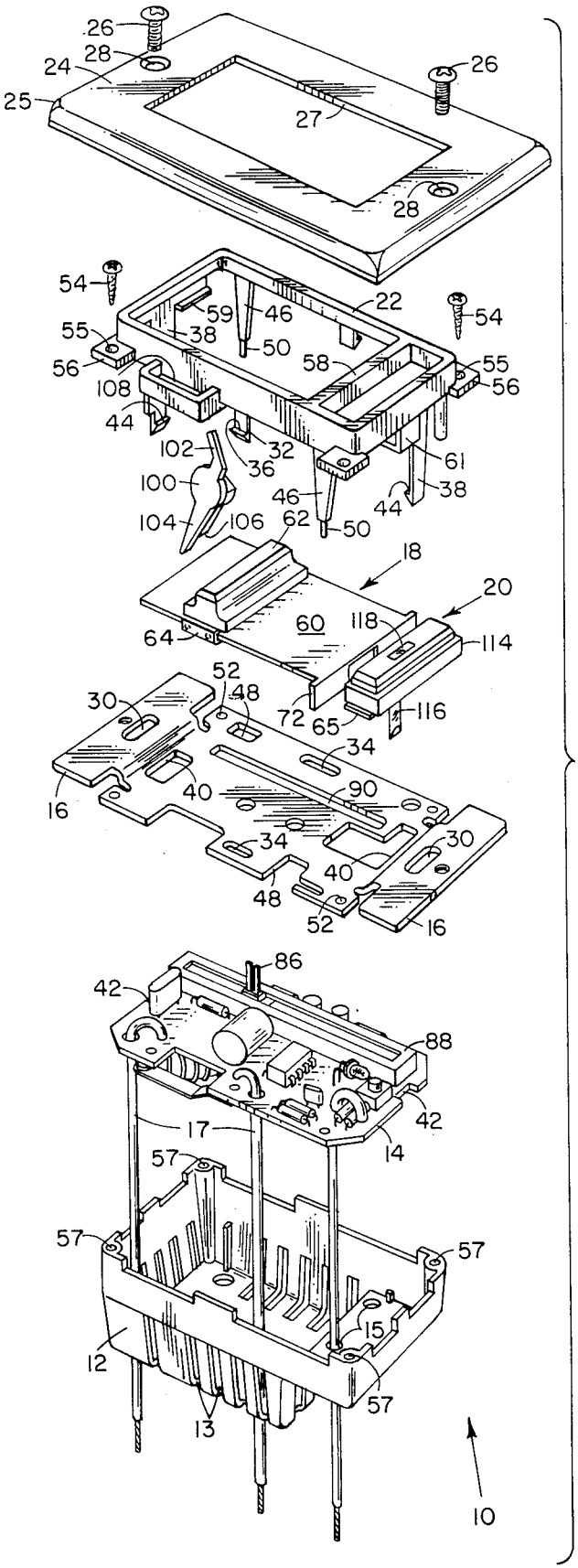
FIG. 2 is an exploded perspective view of the switch showing the internal components thereof.
Figure 3A:
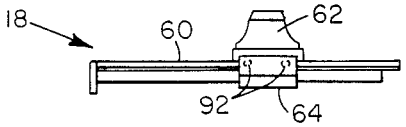
Figure 3B:
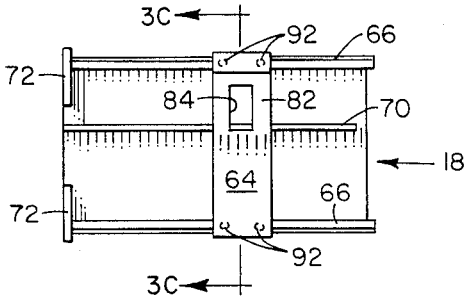
Figure 3C:
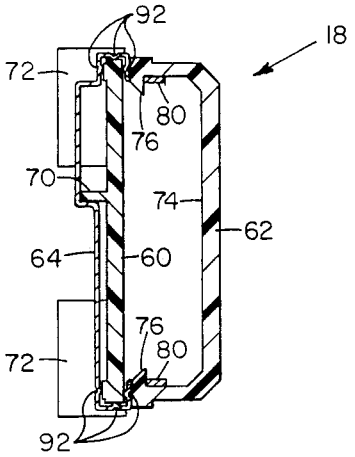

With reference now to the figures, and in particular with reference to FIGS. 1 and 2, there is depicted a control switch 10. FIG. 1 depicts control switch 10 in its assembled state, but the components of control switch 10 may be best understood with reference to FIG. 2, which is an exploded perspective view.

Figure 6:
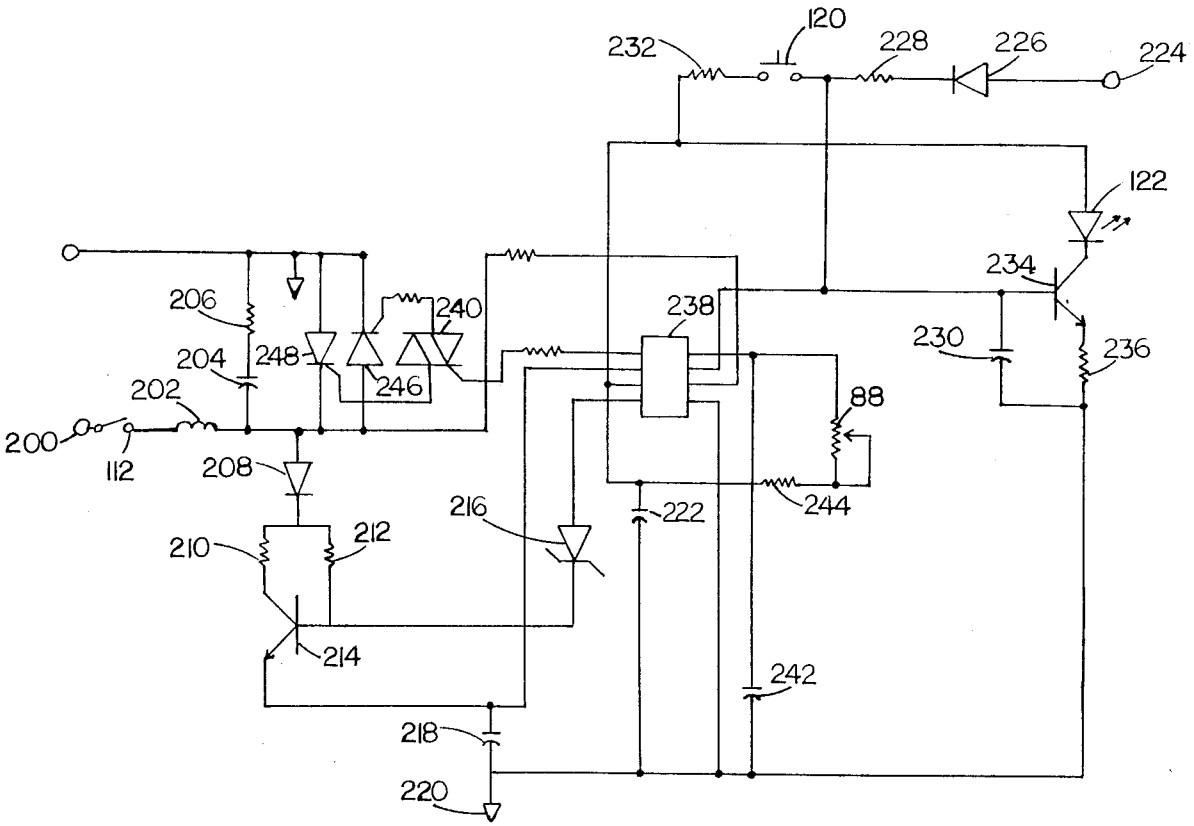
FIG. 6 is an electrical schematic of the preferred embodiment of the present invention.

Switch 10 is generally comprised of a back box 12, a printed circuit board (PCB) 14, a strap 16, slide arrangement 18, on-off button 20, frame 22, and front cover 24. Back box 12 is simply a hard plastic enclosure designed to protect the internal elements of switch 10. It typically has a plurality of slots 13 for ventilation, and holes 15 for allowing passage of wires 17. PCB 14 is used as a substrate for mounting the various electrical components of switch 10. The specific electrical components used for control switch 10 are not relevant to the present application inasmuch as the features disclosed herein are primarily of a mechanical nature. Moreover, the invention as claimed could cover a wide variety of particular electrical designs. Nevertheless, for completeness, an example of the electronics necessary for switch 10 is shown in FIG. 6. FIG. 6 is a representation of the electrical schematics of a high-wattage control switch. The main power line is supplied via line wire 200. In the preferred embodiment, switch 10 runs off a120 volt alternating current power supply. A contact is shown interrupting the line power, the contact being butt contact 112, discussed in detail further below. An inductor 202, capacitor 204, and resistor 206 are supplied for smoothing power surges.

Next, a DC power supply is formed by diode 208, resistors 210 and 212, transistor 214, Zener diode 216, and capacitor 218. The DC power is used by the integrated chip (IC) 238 and light-emitting diode (LED) 122 as discussed below. The negative side of capacitor 218 is connected to ground 220. Another capacitor 222 is used as a filter for the five volt power going to IC 238 and LED 122.

In the preferred embodiment, switch 10 is a three-way switch, having a line 224 for remote activation. Line 224 passes through a diode 226, which merely acts as a half-wave rectifier, and then through resistor 228. A capacitor 230 smooths out the rectified signal from remote line 224. Also attached to this line is a resistor 232 and momentary contact switch 120. As discussed below, contact switch 120 is used to provide complete on-off capability to switch 10.

The next element of interest is LED 122. As discussed below, LED 122 is used to illuminate the on-off button on switch 10, so that it may thereby be located in the dark. LED 122 utilizes DC voltage which was created at transistor 214 and passed through IC 238. Transistor 234 and resistor 236 are also used to provide power to LED 122.

Power to the load (an incandescent light bulb) is essentially regulated by IC 238 and a triac 240. Capacitor 242 provides a sawtooth waveform to IC 234 for timing purposes. A variable resistor 88 (discussed further below), along with a trimming resistor 244, controls the output of IC 238. In turn, IC 238 controls activation of helper triac 240, which turns on silicon controlled rectifiers 246 and 248, depending on the polarity of the current. The regulated power is then passed to load line 250. For further details of the circuitry required for power limiting switches, attention is directed to U.S. Pat. No. 4,087,702 entitled "Digital Electronic Dimmer," and U.S. Pat. No. 4,408,150 entitled "Speed Control System and Method for Electric Motor," which are both hereby incorporated by reference.

Strap 16 is preferably metallic, and is used to secure the entire switch 10 to an electrical supply box mounted in the wall. Strap 16 also serves a heat sink for certain electrical components. Slide arrangement 18 and on-off button 20 provide for manual adjustment of the power transmitted through switch 10, and are discussed further below in conjunction with FIGS. 3A–3D and FIG. 5. Frame 22 acts as a guide for slide arrangement 18, and also holds on-off button 20 in place. Front cover 24 serves as ornamentation, and is affixed to switch 10 by means of screws 26 which pass through holes 28, and then through holes 30 in strap 16. Front cover 24 typically has beveled edges 25 for a more pleasing appearance. A large rectangular cutout 27 receives frame 22.

Frame Assembly

Frame 22 has certain other features which provide a distinct advantage in the assembly of switch 10. Frame 22 employs a plurality of snaps or clips and posts which may be used to hold all of the components of switch 10 together, except for back box 12 and cover 24. First of all, frame 22 has a pair of short clips 32 which are used to join frame 22 to strap 16. Clips 32 pass through holes 34 in strap 16, and the toothed edges 36 of clips 32 catch the inner confines of holes 34, thereby firmly securing slide arrangement 18 and on-off button 20 between frame 22 and strap 16. The length of clips 32 depends on the thickness of slide arrangement 18 and button 20, as well as the thickness of strap 16.

A second set of clips 38 extend from frame 22, through holes 40 in strap 16, and abut notches 42 in PCB 14. The toothed edges 44 of clips 38 catch the inside boundary of notches 42, thereby securing frame 22, slide arrangement 18, button 20, strap 16, and PCB 14 into a single integral unit. The length of clips 38 also depends on the thickness of frame 22 and strap 16, as well as the height of the components on PCB 14. In addition to clips 38, a pair of posts 46 extend downward from frame 22, through another set of holes 48 in strap 16. Posts 46 have pegs 50 at their ends which fit within tiny apertures 52 in PCB 14. This facilitates proper alignment of PCB with the other elements of switch 10. Posts 46 also serve to maintain an adequate clearance between PCB 14 and strap 16, to accommodate the electrical components mounted on PCB 14. It should be noted that, while clips 32 are placed along the length of frame 22 and clips 38 are placed along its width, the clips may be placed nearly anywhere along frame 22 to achieve the aforestated goals.

As previously alluded to, the various clips and posts on frame 22 serve a specific purpose which is now explained. In the assembly of control switches, each unit is typically tested immediately before packing to insure quality control. However, if a defective unit has been completely assembled, i.e., the back box and front cover are attached to the mounting strap, then external coverings must be removed in order to determine the defect. In a mass production setting, this extra effort involved in fixing the defective unit is multiplied a hundredfold, significantly raising labor costs. By utilizing the novel structure of frame 22, this extra cost can be avoided, since frame 22 holds all of the mechanical and electrical components securely without the need of attaching back box 12 or cover 24. Thus, the units may be pretested and, if necessary, repaired before back box 12 and cover 24 are added. Units which pass final testing may then be completed by attaching back box 12 to frame 22 by means of screws 54. Screws 54 enter holes 55 in flanged portions 56 of frame 22, then through holes 52 on strap 16, and are secured in holes 57 of back box 12.

Frame 22 may be metallic, but it is preferably injection-molded plastic. In the preferred embodiment, frame 22 has a partition 58 which separates frame 22 into two portions, one receiving slide arrangement 18 and the other receiving on-off button 20. Frame 22 further has two inwardly-directed flanges 59 for securing slide arrangement 18 therein, and a clip 61 for holding light piping 116 in place (discussed further below).

Slide Arrangement

Another novel feature of the present invention concerns slide arrangement 18, which is shown in several views in FIGS. 3A–3D. Slide arrangement 18 is comprised of slide base 60, slide topper 62, and slide clip 64. Slide base 60 is a generally rectangular, planar member, having two side edges 66, a rail 70, and flanged end pieces 72. Slide topper 62 is oblong in shape, having a concavity 74 along its rear surface, and two small clips 76. Both slide base 60 and slide topper 62 are preferably constructed of a hard plastic. The physical dimensions of slide base 60, as well as slide topper 62, may vary considerably, but in the preferred embodiment, slide base 60 is approximately six centimeters long and three centimeters wide, and slide topper 62 is also approximately three centimeters wide. End pieces 72 assist in securing button 20 within frame 22. Button 20 also has flanged wings 65 to keep button 20 from escaping through the forward portion of frame 22.

Slide clip 64 is also oblong in shape, generally matching the length and width of slide topper 62. Slide clip 64, however, is a thin metallic strip, whose ends 78 have been bent into a generally U-shaped cross-section. In this manner, the ends 78 of slide clip 62 may wrap around the edges 66 of slide base 60, allowing slide clip 62 to slidably move along the length of slide base 60. The ends 78 of slide clip 62 also have a flanged portion 80 which can be best seen in FIG. 3C. Each of the flanges 80 has a small cutout which receives a clip 76 of slide topper 62. Thus, slide topper is securely, yet slidably, mounted to slide base 60. Slide clip 64 further has a raised portion 82 with a generally rectangular cutout 84. As shown in FIG. 2, as well as FIGS. 4A and 4B, two prongs 86 of a variable resistor 88 extend upwardly through a slot 90 in strap 16, and thence to cutout 84. Consequently, when slide topper 62 is manually adjusted, prongs 86 move along variable resistor 88 which, with appropriate electronics, alters the firing point for the triac circuit controlling power output.

There are several novel features in slide arrangement 18 which present distinct advantages over the prior art. First of all, the thinness of slide clip 64 results in a virtually invisible link between slide topper 62 and the internal circuitry of switch 10, imparting a superior aesthetic design. Slide arrangements in the prior art which have a similar fixed slide base, have always required a large, unsightly gap between the base and the frame or cover. Alternatively, prior art slide arrangements in which the slide base moves always leaving a gaping hole at the top or bottom of the slide arrangement whenever the slide is moved to an extreme position, actually revealing the inside of the switch.

The second advantage of slide arrangement 18 relates to indentation or dimples placed near the ends of slide clip 64. As explained above, a thin strip of metal is desirable for linking slide topper 62 to prongs 86; however, the inventors found that the U-shaped design of ends 78 caused excessive friction between slide clip 64 and slide base 60. This difficulty was obviated by the use of dimples 92. In the preferred embodiment, there are a total of six pairs of dimples 92, there being three pairs at each end 78. The first pair is located along the front surface of clip 64, protruding toward base 60. In this manner, clip 64 is slightly dislocated from base 60. The second pair lies along the outside of the U-shaped portion of edge 78; these dimples alleviate friction caused by isometric tension along the length of clip 64. The third pair contacts the upper side of base 60. Thus, frictional sliding forces are essentially eliminated since clip 64 contacts base 60 only at the tips of dimples 92.

The third advantage of slide arrangement 18 involves rail 70. Obviously, if raised portion 82 of clip 64 were to be accidentally flattened, it would not engage prongs 86, rendering switch 10 useless. To avoid this possibility, raised portion 82 partially rides on rail 70, as clearly shown in FIG. 3C. A final advantage of slide arrangement 18 is that all of its components (i.e., base 60, topper 62, and clip 64) are easy to manufacture and assemble.

Air Gap Lever

Figure 4C:
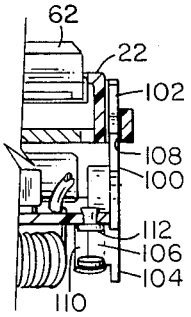
FIGS. 4A through 4C relate to the air gap lever.
Figure 4A:
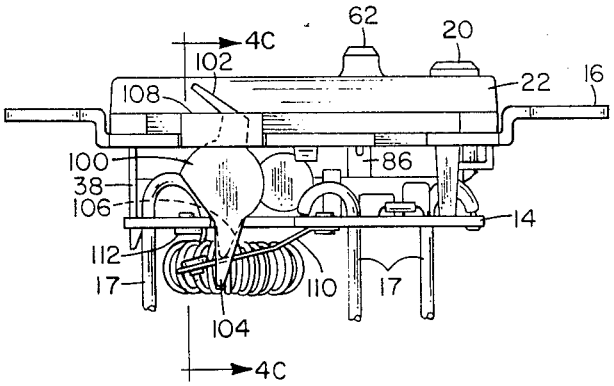
Figure 4B:
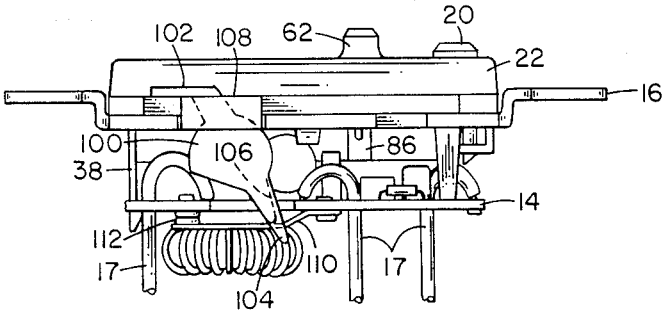

The next novel feature of the present invention pertains to an air gap lever 100 which is shown in FIG. 2, but is more aptly depicted in FIGS. 4A–4C. Air gap lever 100 consists of a generally disk-shaped body having an exposed lever arm 102 and a contact lever arm 104. Contact lever arm 104 further has a lateral cam surface 106 indicated by the dashed lines within arm 104 in FIGS. 4A and 4B. Air gap lever 100 is not fixedly attached to any other element, but rather is loosely held by frame 22. More accurately, frame 22 has a slot 108 formed along one side, and lever arm 102 is positioned in slot 108.

Slot 108 and lever 100 are both situated above an actuator arm 110 of a butt contact 112. Cam surface 106 is forcibly urged against actuator arm 110. For reasons explained below, the circuitry of switch 10 is designed such that, when contact 112 is open, the external power supply to switch 10 is totally cut off. When switch 10 is packed for shipping, air gap lever 100 may be placed in the position shown in FIG. 4A, with exposed arm 102 extending forward from slot 108, and with contact arm 104 extended to its maximum reach, meaning that contact 112 is open. Thus, when the unit is connected to the electric supply wires, there in no danger of electrical shock from touching the exposed wiring. Then, when front cover 24 is placed over switch 10 (the last step in installation), the rear surface of front cover 24 pushes exposed arm 102, rotating air gap lever 100 to the position shown in FIG. 4B. This contact 112, allowing the unit to operate normally. Thus, air gap lever 100 clearly provides a valuable safety measure in the installation of switch 10. Furthermore, air gap level 100 may be reset to its open position if the switch 10 needs to be removed from the wall. A spring or other bias means (not shown) may be used to automatically open lever 100 if front cover 24 is removed.

Light Piping Button

Figure 5:
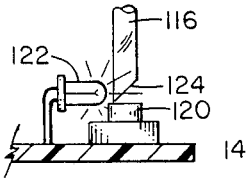
FIG. 5 is a detail side elevational view of the light piping interface with the momentary contact switch and LED.

The final innovative feature of the present invention is found in the interaction of on-off button 20 with the electrical circuitry of switch 10. Button 20 basically consists of rectangular button member 114, and light piping 116, as shown in FIG. 2. Button member 114 has a hole 118 therein through which a portion of light piping 116 extends. The lower end of light piping 116 abuts a momentary contact switch 120 mounted to PCB 14, as depicted in FIG. 5. Immediately adjacent to both momentary contact 120 and light piping 116 is a light-emitting diode (LED) 122. By means of this unique arrangement, the structural member which couples button 20 to the electronics of switch 10 simultaneously acts as a light conduit so that button 20 may be found in a dark room. In the preferred embodiment, the distal tip 124 of light piping 116 is cut at a skewed angle (45°) so that the light from LED 122 is reflected within piping 116 upwards toward the hole 118. The upper portion of light piping 116 preferably has a rough texture to better disperse the light. The circuitry of switch 10 is preferably designed so that LED 122 will energize only when momentary contact switch 120 is in an open state (i.e., there is zero power output from switch 10).

Although the invention has been described with reference to specific embodiments, this description is not meant to be construed in a limiting sense. Various modifications of the disclosed embodiment, as well as alternative embodiments of the invention will become apparent to persons skilled in the art upon reference to the description of the invention. It is therefore contemplated that the appended claims will cover such modifications that fall within the true scope of the invention.

We claim:

1. A slide arrangement in a control switch for operating a variable resistor, said variable resistor having a sliding contact means, said slide arrangement comprising:

a slide base having two side edges, and being generally rectangular in shape, with a length and a width;

a slide topper having two ends, a concavity facing said slide base, and two clips located within said concavity, one at each of said ends of said slide topper; and a slide clip for slidably connecting said slide topper to a front side of said slide base whereby said slide topper essentially rides flat against said slide base, said slide clip being totally concealed when viewed from said front side of said slide base, said slide clip being totally concealed when viewed from said front side of said slide base, said slide clip further coupling said slide topper to said variable resistor so that said slide clip moves said sliding contact means of said variable resistor, said slide clip being constructed from a thin metallic strip having two ends, each of said ends of said slide clip being bent in a U-shape so as to encompass said side edges of said slide base, and each of said ends of said slide clip further having a wing portion having a hole therein for receiving said clips of said slide topper, said slide clip further having a plurality of dimples impressed thereon at each of said ends of said slide clip, said dimples being the only portion of said slide clip contacting said slide base, thereby minimizing frictional resistance as said slide clip and said slide topper slide across said slide base, said slide clip further being generally rectangular in shape, having a length slightly longer than said width of said slide base.

2. The slide arrangement of claim 1 wherein said variable resistor has prong means for adjustment, and said slide clip has a raised portion extending away from said slide base, said raised portion of said slide clip having a cutout therein for receiving said prong means of said variable resistor.

3. The slide arrangement of claim 2 wherein said slide base further has a longitudinal rail extending toward said slide clip, and positioned so as to support said raised portion of said slide clip.

4. A control switch comprising:

a frame;

a printed circuit board;

a variable resistor having a sliding contact means, said variable resistor being mounted on said printed circuit board and having a prong means for adjustment;

a slide arrangement placed within said frame, said slide arrangement comprising:

a slide base having two side edges, and being generally rectangular in shape, having a length and a width;

a slide topper having two ends, a concavity facing said slide base, and two clips located within said concavity, one at each of said ends of said slide topper; and a slide clip for slidably connecting said slide topper to a front side of said slide base whereby said slide topper essentially rides flat against said slide base, said slide clip being totally concealed when viewed from said front side of said slide base, said slide clip further coupling said slide topper to said variable resistor so that said slide clip moves said sliding contact means on said variable resistor, said slide clip being constructed from a thin metallic strip having two ends, each of said ends of said slide clip being bent in a U-shape so as to encompass said side edges of said slide base, and each of said ends of said slide clip further having a wing portion having a hole therein for receiving said clips of said slide topper, said slide clip further having a plurality of dimples impressed thereon at each of said ends of said slide clip, said dimples being the only portion of said slide clip contacting said slide base, thereby minimizing frictional resistance as said slide clip and said slide topper slide across said slide base, said slide clip further being generally rectangular in shape, having a length slightly longer than said width of said slide base, said slide clip also having a raised portion extending away from said slide base, said raised portion of said slide clip having a cutout therein for receiving said prong means of said variable resistor.

5. The control switch of claim 4 further comprising:

a button member for on-off control of an electrical load, said button member placed within said frame, adjacent to said slide arrangement;

a light source attached to said printed circuit board; an electrical contact switch mounted on said printed circuit board;

circuit means connecting said electrical contact switch to said variable resistor whereby said electrical contact switch changes operative states between enabling and disabling said variable resistor; and means coupling said button member to said electrical contact switch mounted on said printed circuit board, said coupling means further transmitting light from said light source to said button member, whereby said button member may be located in the dark.

6. The control switch of claim 5 wherein:

said light source is mounted on the said side of said printed circuit board as said contact switch, proximate to said contact switch;

said button member has a hole therein;

said coupling means comprising a light piping member having first and second ends, said first end located within said hole of said button member, and said second end extending away from said button member toward said printed circuit board, said second end of said light piping member further being positioned proximate to said light source and said contact switch.

7. The control switch of claim 6 wherein said light source is a light-emitting diode directed toward said light piping member, and said second end of said light piping member is cut at an angle whereby light from said light-emitting diode is reflected within said light piping member toward said hole in said button member.

8. A control switch comprising:

a printed circuit board;

a strap for mounting said control switch to a wall;

a frame having a slot, and further having a first means for securing said strap to said frame, and second means for securing said printed circuit board to said frame, whereby all electrical and mechanical components of said switch are operatively held together, allowing testing of said switch prior to mounting a back box thereon, said first securing means comprising a first plurality of clips extending from a rear portion of said frame toward said strap, said clips having a toothed portion which catches an edge of strap, and said second securing means comprising a second plurality of clips extending from said rear portion of said frame toward said printed circuit board, said second plurality of clips having a toothed portion which catches an edge of said circuit board;

a butt contact mounted on said printed circuit board;

an actuator arm having first and second ends, said first end being mounted on said printed circuit board proximate said butt contact, and said second end being forcibly urged against said butt contact when said actuator arm is in its relaxed state, said butt contact and said actuator arm forming an override on-off switch;

a generally disk-shaped lever member having an exposed lever arm and a contact lever arm, said exposed lever arm extending through said slot in said frame, and said contact lever arm extending away from said frame toward said actuator arm, a portion of said contact lever arm further having a cam surface slidably urged against said actuator arm whereby:

when said lever member is in a first position, said exposed lever arm extends outward from said frame in a direction opposite said printed circuit board, and said cam surface of said contact lever arm forces said actuator arm to its open state, thereby preventing accidental electrical shock prior to installation; and when a front cover is placed on said control switch, said front cover contacts said exposed lever arm, causing said lever member to rotate to a second position wherein said exposed lever arm is essentially parallel to said frame, and said cam surface of said contact lever arm is no longer in contact with said actuator arm, thereby closing said override on-off switch;

a variable resistor having prong means for sliding adjustment, said variable resistor being mounted on said printed circuit board;

a slide base having two edges and a longitudinal rail, said slide base being placed within said frame and said slide base generally rectangular in shape having a length and a width;

a slide topper having two ends, a concavity facing said slide base, and two clips located within said concavity, one at each of said two ends;

a slide clip for slidably connecting said slide topper to a front side of said slide base whereby said slide topper essentially rides flat against said slide base, said slide clip being constructed from a thin metallic strip having two ends, each of said ends being bent in a U-shape so as to encompass said side edges of said slide base, and each of said ends further having a wing portion having a hole therein for receiving said clips of said slide topper, said slide clip being totally concealed when viewed from said front side of said slide base, said slide clip also having a plurality of dimples impressed thereon at said ends thereof, said dimples being the only portion of said slide clip contacting said slide base, thereby minimizing frictional resistance as said slide clip and slide topper slide across said slide base, said slide clip further being generally rectangular in shape, having a length slightly longer than the width of said slide base, and slide clip having a raised portion extending away from said slide base, said raised portion of said slide clip having a cutout therein for receiving said prong means of said variable resistor, and said raised portion of said slide clip being supported by said longitudinal rail of said slide base;

a button member having a hole therein, placed within said frame;

a light-emitting diode attached to said printed circuit board on a side of said printed circuit board facing said frame;

a momentary contact switch attached to said printed circuit board proximate said light-emitting diode;

a light piping member having a first and second ends, said first end located within said hole of said button member, and said second end extending away from said button member toward said printed circuit board, said second end of said light piping member further being positioned proximate to said light-emitting diode and said momentary contact switch, whereby depression of said button member causes said light piping member to forcibly contact said momentary contact switch, said light-emitting diode further being directed toward said light piping member, and said second end of said light piping member being cut at an angle whereby light from said light-emitting diode is reflected within said light piping member toward said hole in said button member, whereby said button member may be located in the dark.

9. A control switch comprising:

a frame;

a printed circuit board;

a variable resistor having a sliding contact means, said variable resistor being mounted on said printed circuit board;

a slide arrangement placed within said frame, said slide arrangement comprising:

a slide base;

a slide topper; and means for slidably connecting said slide topper to a front side of said slide base whereby said slide topper essentially rides flat against said slide base, said connecting means being totally concealed when viewed from said front side of said slide base, said connecting means further coupling said slide topper to said variable resistor so that said connecting means moves said sliding contact means on said variable resistor;

a button member for on-off control of an electrical load, said button member placed within said frame, adjacent to said slide arrangement;

a light source attached to said printed circuit board;

an electrical contact switch mounted on said printed circuit board;

circuit means connecting said electrical contact switch to said variable resistor whereby said electrical contact switch changes operative states between enabling and disabling said variable resistor; and means coupling said button member to said electrical contact switch mounted on said printed circuit board, said coupling means further transmitting light from said light source to said button member, whereby said button member may be located in the dark.

* * * * *